United States Patent [19]

Jugle et al.

[11] 3,983,045

[45] Sept. 28, 1976

[54] THREE COMPONENT DEVELOPER COMPOSITION

[75] Inventors: Don B. Jugle, Penfield; Charles J. Levine, Rochester, both of N.Y.

[73] Assignee: Xerox Corporation, Stamford, Conn.

[22] Filed: Feb. 19, 1974

[21] Appl. No.: 443,659

Related U.S. Application Data

[63] Continuation of Ser. No. 188,570, Oct. 12, 1971, abandoned.

[52] U.S. Cl. ..... 252/62.1 P; 96/15; 427/14

[51] Int. Cl.[2] ..... G03G 9/02

[58] Field of Search..... 252/62.1; 96/15 D; 117/17.5; 427/14

[56] References Cited

UNITED STATES PATENTS

| | | | |
|---|---|---|---|
| 2,613,158 | 10/1952 | Walton et al. | 252/62.1 X |
| 2,986,521 | 5/1961 | Wielicki | 252/62.1 |
| 3,165,420 | 1/1965 | Tomanek et al. | 117/17.5 |
| 3,262,806 | 7/1966 | Gourge | 117/17.5 |
| 3,565,805 | 2/1971 | Jones et al. | 252/62.1 |
| 3,655,374 | 4/1972 | Palermiti et al. | 96/15 D X |

*Primary Examiner*—Roland E. Martin, Jr.
*Attorney, Agent, or Firm*—James J. Ralabate; James H. Laughlin, Jr.; James Paul O'Sullivan

[57] ABSTRACT

A developer composition comprising (1) electroscopic toner particles (2) a friction-reducing material of a hardness less than said toner and having greater fricton-reducing characteristics than said toner material, and (3) a finely divided nonsmearable abrasive material of a hardness greater than said friction-reducing and toner materials. An imaging and development process utilizing the above-identified composition including the step of maintaining the buildup of friction-reducing material on an imaging surface in the submicron range without completely removing or preventing said buildup, by the combined action of a cleaning force wiping at least any residual developed image from at least a portion of said imaging surface.

4 Claims, No Drawings

THREE COMPONENT DEVELOPER COMPOSITION

This is a continuation of application Ser. No. 188,570, filed Oct. 12, 1971, now abandoned.

BACKGROUND OF THE INVENTION

This invention relates to imaging systems, and more particularly, to improved electrostatographic developing materials, their manufacture and use.

The formation and development of images on the surface of photoconductive materials by electrostatic means is well known. The basic electrophotographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layers exposed to the light and developing the resulting electrostatic latent image by depositing on the image a finely divided electroscopic material referred to in the art as "toner". The toner will normally be attracted to those areas of the layer which retain a charge thereby forming a toner image corresponding to the electrostatic latent image. This powder image may then be transferred to a support surface such as paper. The transferred image may substantially be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if the powder image transfer step is not desired. Other suitable fixing means such as solvent or overcoating treatment may be substituted for the foregoing heat fixing step.

Several methods are known for applying the electroscopic particles to the electrostatic latent image to be developed. One development method, as disclosed by E. N. Wise in U.S. Pat. No. 2,618,552, is known as "cascade" development. In this method, a developer material comprising relatively large carrier particles having finely divided toner particles electrostatically coated thereon is conveyed to and rolled or cascaded across the electrostatic image bearing surface. The composition of the carrier particles is so selected as to triboelectrically charge the toner particles to their desired polarity. As the mixture cascades or rolls across the latent image bearing surface, the toner particles are electrostatically deposited and secured in positive development processes to the charged portion of the latent image and are not deposited on the uncharged or background portions of the image. Most of the toner particles accidentally deposited in the background areas are removed by the rolling carrier, due apparently, to the greater electrostatic attraction between the toner and the carrier than between the toner and the discharged background. The carrier and excess toner are then recycled. This technique is extremely good for development of line copy images.

Another method for developing electrostatic images is the "magnetic brush" process as disclosed, for example, in U.S. Pat. No. 2,874,063. In this method, a developer material containing toner particles and magnetically attractable carrier particles are carried by a magnet. The magnetic field of the magnet causes alignment of the magnetically attractable carrier particles into a brushlike configuration. This magnetic brush is engaged with the electrostatic image bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method, a developer material comprising electrically charged toner particles in a gaseous fluid is passed adjacent the surface bearing the electrostatic latent image. The toner particles are drawn by electrostatic attraction from the gas to the latent image. This process is particularly useful in continuous tone development.

Other development methods such as "touchdown" development as disclosed by R. W. Gundlach in U.S. Pat. No. 3,166,432 may be used where suitable.

Generally, commercial electrostatographic development systems utilize automatic machines. Since automatic electrostatographic imaging machines should operate with a minimum of maintenance, the developer employed in the machines should be capable of being recycled through many thousands of cycles. In automatic xerographic equipment, it is conventional to employ an electrophotographic plate which is charged, exposed and then developed by contact with a developer mixture. In some automatic machines, the toner image formed on the electrophotographic plate is transferred to a receiving surface and the electrophotographic plate is then cleaned for reuse. Transfer is effected by a corona generating device which imparts an electrostatic charge to attract the powder from the electrophotographic plate to the recording surface. The polarity of charge required to effect image transfer is dependent upon the visual form of the original copy relative to the reproduction and to the electroscopic characteristics of the developing material employed to effect development. For example, where a positive reproduction is to be made of the positive original, it is conventional to employ a positive corona to effect transfer of a negatively charged toner image to the recording surface. When a positive reproduction from a negative original is desired, it is conventional to employ positively charged toner which is repelled by the charged areas on the plate to the discharged areas thereon to form a positive image which may be transferred by negative polarity corona. In either case, a residual powder image usually remains on the image after transfer. Because the plate may be reused for a subsequent cycle, it is necessary that the residual image be removed to prevent "ghost images" from forming on subsequent copies and toner film from forming on the photoreceptor surface. In a positive to positive reproduction process described above, the residual powder is tightly retained on the plate surface by a phenomenon not fully understood which prevents complete transfer of the powder to the support surface, particularly in the image area. Incomplete transfer of toner particles is undesirable because image density of the ultimate copy is reduced and highly abrasive photoreceptor cleaning techniques are required to remove the residual toner from the photoreceptor surface. This imaging process is ordinarily repeated for each copy reproduced by the machine any time during the reusable life of the developer and the electrophotographic plate surface.

Various electrostatographic plate cleaning devices such as the "brush" and the "web" cleaning apparatus are known in the prior art. A typical brush cleaning apparatus is disclosed by L. E. Walkup et al, in U.S. Pat. No. 2,832,977. The brush type cleaning means usually comprises one or more rotating brushes, which remove residual powder from the plate into a stream of air which is exhausted through a filtering system. A typical web cleaning device is disclosed by W. E. Graff, Jr. et al in U.S. Pat. No. 3,186,838. As disclosed by Graff, Jr. et al., removal of the residual powder on the plate is effected by passing a web of fibrous materials over the plate surface. Another system for removing residual toner particles from the surface of a photoreceptor comprises a flexible cleaning blade which wipes or scrapes the residual toner from the photoreceptor surface as the surface moves past the blade.

Unfortunately, the foregoing cleaning systems do not effectively remove all types of toner particles from all types of reusable photoreceptors. This is not a shortcoming of the cleaning system, but a shortcoming of particular toners used in conjunction with particular photoreceptors. If a particular toner would not tend to form an adherent residual film on a particular photoreceptor, the cleaning systems described would effectively remove all residual toner. However, many commercial toners of their very nature do tend to form a residual film on reusable photoreceptors. The formation of such films is undesirable because it adversely affects the quality of undeveloped and developed images. The toner film problem of these particular toners is acute in high speed copying and duplicating machines where contact between the developer and the imaging surface occurs a great many more times and at a higher velocity than in conventional electrostatographic systems. Ultimately, the toner buildup becomes so great that effective copying or duplicating is impaired. As a result, more stringent means, e.g. solvent removal, are necessary to remove this type of film. Frequent shutdown of the apparatus, in order to clean the surface of the photoreceptor is obviously undesirable since the machine is taken out of commission and repeated techniques of this type wear down the photoreceptor surface.

Thus, there is a continuing need for a technique for eliminating the buildup of toner film on the surface of a photoreceptor. Electrostatographic systems and, in particular, the imaging, developing and cleaning aspects of such systems would be significantly advanced if the foregoing problems were effectively overcome.

SUMMARY OF THE INVENTION

Accordingly, it is an object of the invention to provide a developer composition which effectively eliminates toner film buildup.

It is another object of the invention to provide a developer composition which improves solid area print density.

It is a further object of the invention to provide a developer composition which reduces background density of copies.

It is yet another object of the invention to provide a developer composition having enhanced and stabilized triboelectric characteristics.

It is still another object of the invention to provide a developer composition which permits effective long term prevention or control of toner filming on a reusable photoreceptor.

A still further object of the invention is to provide a developer composition of increased life, i.e., more prints per unit weight of developer.

Still another object of the invention is to provide a developer composition which yields copies of comparatively high optical density.

It is another object of the invention to provide a process which prevents undesirable buildup of developer components on reusable electrostatographic imaging surfaces.

It is a further object of this invention to provide an electrostatographic imaging process employing developing materials which provides for more effective cleaning of reusable electrostatographic imaging surfaces.

It is another object of this invention to provide an electrostatographic imaging process employing developer mixtures which are readily transferable from an electrostatographic surface to a transfer surface.

A further object of the invention is to provide an improved developer composition and process which yields images and copy with no loss of resolution.

Yet a further object is to provide an improved developer composition and process with no loss in fusing efficiency.

A still further object of the invention is to provide an improved developer composition having less tendency for toner blocking.

A further object of the invention is to provide an improved developer composition which increases the life of imaging surface cleaning members.

The above objects and others are accomplished by providing an electrostatographic developing material comprising particles, said particles including (1) a finely divided, electroscopic, toner material; (2) a minor proportion based on the weight of said toner of a finely divided solid frictionreducing material having a hardness less than said toner material and having greater friction-reducing characteristics than said toner material, said friction-reducing material having a greater tendency than said toner material of forming a thin, adherent film deposit on a surface when applied from a mixture of said materials with a shearing force; and (3) a minor proportion based on the weight of said toner material of a finely divided abrasive material of a hardness greater than said frictionreducing and toner materials.

Thus, the developer composition of the present invention comprises three constituents, a toner material and a dual additive comprising a friction-reducing material and a finely divided abrasive type material.

Other objects of the invention are accomplished through a cyclic imaging and development process comprising forming an electrostatic latent image on an imaging surface and forming a developed image by contacting said imaging surface with an electrostatographic developing mixture comprising particles, said particles including (1) finely divided electroscopic toner material, (2) a minor proportion based on the weight of said toner of a finely divided, solid, friction-reducing material having a hardness less than said toner material and having greater friction-reducing characteristics than said toner material, said friction-reducing material having a greater tendency than said toner material of forming a thin, adherent film deposit on a surface when applied from a mixture of said materials with a shearing force; and (3) a minor proportion based on the weight of said toner material of a finely divided, nonsmearable, abrasive material of a hardness greater than said frictionreducing and toner materials; removing at least a portion of at least any residual developed image from said imaging surface by a force which causes the developer mixture to be wiped across at least a portion of said imaging surface; and repeating the process sequence at least one additional time.

The toner material of the present invention may be any electroscopic toner material which preferably is pigmented or dyed. Typical toner materials include polystyrene resin, acrylic resin, polyethylene resin, polyvinyl chloride resin, polyacrylamide resin, methacrylate resin, polyethylene terephthalate resin, polyamide resin, and copolymers, polyblends and mixtures thereof. Vinyl resins having a melting point or melting range starting at least about 110°F are especially suitable for use in the toner of this invention. These vinyl resins may be a homopolymer or a copolymer of two or more vinyl monomers. Typical monomeric units which may be employed to form vinyl polymers include: styrene, vinyl naphthalene, mono-olefins, such as, ethylene, propylene, butylene, isobutylene and the like, vinyl esters, such as vinyl acetate, vinyl propionate, vinyl benzoate, vinyl butryrate and the like, esters of alphamethylene aliphatic monocarboxylic acids such as methyl acrylate, ethyl acrylate, n-butyl acrylate, isobutyl acrylate dodecyl acrylate, n-octyl acrylate, methyl methacrylate, ethyl methacrylate, butyl methacrylate and the like; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; and mixtures thereof. Suitable materials employed as the toner will usually have an average molecular weight between about 3,000 to about 500,000.

Any suitable pigment or dye may be employed as the colorant for the toner particles. Toner colorants are well known and include, for example, carbon black, nigrosine dye, aniline blue, Calco Oil Blue, chrome yellow, ultramarine blue, duPont Oil Red, quinoline yellow, methylene blue chloride, phthalocyanine blue, Malachite Green Oxalate, lamp black, Rose Bengal and mixtures thereof. The pigment or dyes should be present in the toner in a sufficient quantity to render it highly colored so that it will form a clearly visible image on a recording member. Thus, for example, where conventional xerographic copies of typed documents are desired, the toner may comprise a black pigment such as carbon black or a black dye such as Amaplast Black Dye available from the National Aniline Products, Incorporated. Preferably, the pigment is employed in an amount of from about 1% to about 30%, by weight, based on the total weight of the colored toner. If the toner colorant employed is a dye, substantially smaller quantities of the colorant may be used.

When the toner materials of the present invention are to be employed in the aforementioned development processes, the toner should have an average particle size less than about 30 microns.

The solid lubricating or friction-reducing additive of the present invention is a material which is capable of forming a thin, adherent film deposit on the imaging surface of a reusable photoreceptor during the repeating cycles of an electrostatographic system. This material need not be one which will form a completely continuous film on the imaging surface, although many will form a continuous film. Other friction-reducing materials will tend to fill the valleys of the surface and minute peaks will be coated with no more than a monolayer of the friction-reducing material. This material must have characteristics which permit its deposition on an imaging surface more easily than the toner material employed. The hardness of the friction-reducing material is undoubtedly related to the ability of this additive to form a deposit or film on the imaging surface. Thus, the friction-reducing material must be softer than the selected toner material. Any of the suitable standard hardness tests can be employed in determining whether or not a selected friction-reducing material is softer than a selected toner material. For example, using the Shore Durometer A, B, C or D Hardness scales, following the technique of ASTM D-1706, any material having a hardness less than that assigned to a selected toner would be effective providing the material has the other characteristics detailed below. The melting point of the friction-reducing additive is limited mainly by the ambient operating conditions and obviously should be at least somewhat higher than the ambient temperature.

The friction-reducing material also must have greater friction-reducing characteristics than the selected toner material. Any dynamic technique can be employed to determine the relative friction-reducing characteristics of the contemplated friction-reducing materials versus contemplated toner materials. In general, the test involves merely comparing the degree of reduction in friction caused by the friction-reducing material versus the toner material when each is placed between two mating surfaces in relative motion. The materials of the mating surfaces should be reasonably flat and each should have a kinetic coefficient of friction greater than that of the friction-reducing material and the toner material.

One technique found to be adequate is as follows: The object of the technique is to traverse a blade of rubberlike material across imaging surfaces which had been buffed with the materials to be tested, followed by a determination of the relative coefficient of friction values of the buffed-on materials.

A blade holder and sled mechanism is employed in conjunction with a base for supporting an imaging surface. The blade is a strip of a commercially available polyurethane, rubberlike material, 1½ inch long, 1/16 inch thick and ½ inch wide. The edge of the strip, which will make contact with the imaging surface, is cut or chamfered at an angle of 60° to the horizontal. The blade will be held with the chamfered region facing away from the direction of traverse of the blade. It will be held at an angle of 22° with respect to the imaging surface in a wiping, rather than chiseling, attitude. The imaging surfaces are selenium coated aluminum plates, 12 × 14 inches in size. The coefficient of friction measurements are made with an Instron Model TM (Instron Corporation, Canton, Massachusetts) attached to the blade holder sled. The force necessary to pull the sled alone is determined and this is subtracted from the force necessary to pull the sled and move the blade across the imaging surface. This results in the kinetic force of friction necessary to pull the blade alone. The normal force of the blade moving along the imaging surface is measured with a force gauge. The kinetic force divided by this value results in a value of the kinetic coefficient of friction.

The coefficient of friction values for as many selenium plates as there are materials to be tested is determined. Any plate having a value deviating from the mean by more than 10% is discarded. Using a different plate and blade for each material to be tested, each plate is buffed in a uniform manner with the material to be tested. Equal weights of material are employed during application of the material to the plates.

In this manner, one skilled in the art can determine the friction-reducing characteristics of selected materials versus contemplated toner materials. Specific examples of materials tested in this manner are given below.

The friction-reducing materials also must have a resistivity high enough not to interfere with the latent image on the imaging surface.

Typical friction-reducing materials having the above defined characteristics include: saturated or unsaturated, substituted or unsubstituted fatty acids, preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acid; isophthalic acid, 2,5 dimethylterephthalic acid, 2,5 dichloroterephthalic acid, p-phenylene diacrylic acid, anisic acid, terephthaldehyde, metal terephthalates e.g. sodium terephthalate; cholesterol; Dechlorane, i.e. perchloropentacyclodecane polycaprolactones having a molecular weight of about less than 4000, and low molecular weight fluorocarbon compounds such as waxy short chain telomers of tetrafluoroethylene, low molecular weight, smearable polytetrafluorethylene powders, etc. The metal salts of the above identified fatty acids include, but are not limited to, the lithium, sodium, potassium, copper, rubidium, silver, magnesium, calcium, zinc, strontium, cadmium, barium, mercury, aluminum, chromium, tin, titanium, zirconium, lead, manganese, iron, cobalt and nickel salts and mixtures of said salts. Ammonium and substituted ammonium salts of fatty acids are also contemplated. Specific fatty acids contemplated include caprylic, pelargonic, capric, undecanoic, lauric, tridecanoic, myristic, pentadecanoic, palmitic, margaric, stearic, arachidic, behenic, lignoceric, cerotic and mixtures thereof. The corresponding solid fatty alcohols, esters, amides, derivatives thereof and mixtures thereof are contemplated.

Specific mono and polyhydric alcohol esters of fatty acids which are contemplated are derived from $C_1$ to $C_{20}$ alcohols which form esters with fatty acids which are solid under the conditions of contemplated use. For example, methyl, ethyl, propyl, etc., alcohols or alkylene diols and triols of from 2 to 10 carbon atoms at least partially esterified with $C_8$–$C_{35}$ fatty acids are contemplated. Examples of contemplated esters include: methyl stearate, ethylene glycol monostearate, glyceryl tri-(-12-hydroxy stearate), 1,2,4-butanetriol tristearate, etc.

The polyethylene glycols and methoxypolyethylene glycols are condensation products known commercially as Carbowaxes. The contemplated Carbowaxes are solid, waxlike materials having a molecular weight of up to about 6000.

When a developer composition containing a friction-reducing material as the additive is employed for general copying purposes, there is noted an excessive buildup of this additive on the imaging surface in somewhat the same fashion as toner without an additive builds up. This buildup is also particularly acute in high speed copying and duplicating machines where contact between the developer and the imaging surface occurs a great many more times and at higher velocities than in conventional electrostatographic systems. It was discovered that the utilization of a comparatively hard, finely divided nonsmearable abrasive material could be employed in conjunction with the friction-reducing material with outstanding success.

With no intention of being bound by any theory of action, it is believed that a friction-reducing material of the type defined, if used as the sole developer additive, forms a lubricating film on an imaging surface more easily and to the essential exclusion of a toner film. This film not only permits more effective removal of residual toner material but also increases the life and efficiency of any cleaning member used to remove residual developer. During use, however, the friction-reducing material will build up to an extent which gradually degrades the quality of copies. By including in the developer composition a minor proportion of a finely divided, nonsmearable mildly abrasive material, this material will control the buildup of the friction-reducing material by its abrasive action when a cleaning means removes residual developer from an imaging surface with a force which causes the developer mixture to be wiped across at least a portion of the imaging surface. This combination of additives permits the friction-reducing material to perform its function while the abrasive material prevents an excessive, interference layer of lubricant from building up. In addition, the proper triboelectric difference between a charging means, e.g. carrier particles, and the toner material is at least stabilized since the abrasive material prevents a nullifying buildup of toner on the charging means.

Contemplated abrasive materials include colloidal silica, surface modified organophilic silica, aluminum silicate, surface treated aluminum silicate, titanium dioxide, alumina, calcium carbonate, antimony trioxide, barium titanate, calcium titanate or strontium titanate, $CaSiO_3$, MgO, ZnO, $ZrO_2$ etc. and mixtures thereof.

The particularly preferred materials are those which have been surface modified to impart hydrophobic characteristics thereto. For example, hydrophobic silicas are prepared by reacting freshly prepared colloidal silica with at least one organosilicon compound having hydrocarbon groups as well as hydrolyzable groups attached to its silicon atom. In one technique, the reactants and steam are pneumatically introduced in parallel flow into a fluidized bed reactor heated to about 400°C. The organosilicon compound reacts with silanol groups on the surface of the $SiO_2$ particles and chemical attachment between the silicon atom in the organosilicon compound and the silicon atom in the $SiO_2$ occurs through an oxygen atom. Any suitable hydrocarbon or substituted hydrocarbon organic group directly attached to a silicon atom in the organosilicon compound may be employed in preparing the modified silica. The organic group is preferably one which imparts hydrophobic characteristics to the abrasive material to improve the stability of developer materials under varying humidity conditions. The organic groups may comprise saturated or unsaturated hydrocarbon groups or derivatives thereof. Saturated organic groups include methyl, ethyl, propyl, butyl, chloropropyl and chloromethyl groups. Examples of typical organosilicon compounds include: dimethyl dichlorosilane, trimethyl chlorosilane, methyl trichlorosilane, vinyl triethoxy silane. The type of organo groups can influence the triboelectric characteristics of the developer. For example, aminopropylsilane treated with silica can be used in a reversal type developer.

The particle size of the abrasive additive should fall within the submicron range of from about 1 to about 500 millimicrons and preferably, between about 10 to about 100 millimicrons.

Concerning the comparative hardness of the abrasive type material, this material must be harder than both the toner material and the friction-reducing material. While most of the materials disclosed can be considered to be very hard materials falling within Mohs' hardness scale, it is to be understood that any material of less hardness than talc of Mohs' hardness scale can also be employed so long as it is harder than the toner material and friction-reducing material. Materials softer than talc are conveniently classified according to the Shore durometer penetration technique and placed within either scale A, B, C and D of this test procedure.

The chemical composition of the abrasive additive is not critical so long as it does not introduce deleterious contaminents or adversely affect the imaging and development aspects of an electrostatographic system. In addition, there is no particular criticality surrounding the shape of each abrasive particle since both spherical and irregularly shaped additives function effectively. Preferred materials are Aerosil R972, a hydrophobic silica available from DeGussa Incorporated, New York, New York and Kaophile-2, a hydrophobic aluminum silicate, available from Georgia Kaolin Company, Elizabeth, New Jersey.

The composition of the present invention finds utility in all known electrostatographic development systems. This includes systems which employ a carrier material such as magnetic brush development and cascade development as well as systems which do not necessarily employ a carrier material such as powder cloud development, fiber brush development and touchdown development.

Suitable coated and uncoated carrier materials for cascade development are well known in the art. The carrier particles comprise any suitable solid material, provided that the carrier particles acquire a charge having an opposite polarity to that of the toner particles when brought in contact with the toner particles so that the toner particles cling to and surround the carrier particles. When a positive reproduction of the electrostatic images is desired, the carrier particles are selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus, the materials for the carrier particles are selected in accordance with its triboelectric properties in respect to the electroscopic toner so that when mixed or brought into mutual contact, one component of the developer is charged positively if the other component is below the first component in a triboelectric series and negatively if the other component is above the first component in a triboelectric series. By proper selection of materials in accordance with their triboelectric effects, the polarities of their charge, when mixed, are such that the electroscopic toner particles adhere to and are coated on the surface of carrier particles and also adhere to that portion of the electrostatic image bearing surface having a greater attraction for the toner than the carrier particles. Typical carriers include: steel, flintshot, aluminum potassium chloride, Rochelle salt, nickel, potassium chlorate, granular zircon, granular silica, methyl methacrylate, glass and the like. The carriers may be employed with or without a coating. Many of the foregoing and other typical carriers are described in U.S. Pat. No. 2,618,552. An ultimate coated particle diameter between about 50 microns to about 2000 microns is preferred because the carrier particles then possess sufficient density and inertia to avoid adherence to the electrostatic images during the cascade development process. Adherence of carrier beads to electrostatic drums is undesirable because of the formation of deep scratches on the surface during the image transfer and drum cleaning steps. Also, print deletion occurs when large carrier beads adhere to xerographic imaging surfaces. For magnetic brush development, carrier particles having an average particle size less than about 800 microns are satisfactory. Generally speaking, satisfactory results are obtained when about 1 part toner is used with about 10 to about 1000 parts by weight of carrier in the cascade and magnetic brush developers.

Concerning the broad relative proportions of the toner material versus the additive materials, functionally stated, the friction-reducing material should be present in a proportion at least sufficient to form on adherent deposit substantially uniformly distributed over at least 20% of the area of an imaging surface during cyclic use of the imaging surface. It is preferred that approximately 100% of the imaging area becomes coated with the friction-reducing material. It has been found that from about 0.01 to about 10% by weight of friction-reducing material based on the weight of the toner material will achieve the foregoing degree of coverage. A particularly preferred ratio is from about 0.1% to about 2.0% by weight of friction-reducing material based on the weight of toner.

Functionally stated, the abrasive material must be present in a relative proportion sufficient to maintain the thickness of the friction-reducing film deposit within the submicron range i.e. less than 10,000A, in order to avoid having an interference film, yet this proportion must not be so great as to completely remove the deposit or prevent one from forming. If the relative proportion is so great that no film is retained or formed, the mildly abrasive material will be acting directly on the photoreceptor and for long term operation this can contribute to shortening the life of the photoreceptor and certain of the cleaning means employed in the system. As a lower limit, as long as about 5A of the friction-reducing material is available on the imaging surface the benefits of the present invention will be realized. One skilled in the art can readily determine optimum ratios of the dual additives by monitoring the thickness of the residual friction-reducing film. The use of a radioactive tracer in the friction-reducing material is one effective means of optimizing proportions. Comparative long term runs will also be of assistance. Generally, it has been found that from about 0.01% to about 10% by weight of abrasive material based on the weight of the toner material will achieve the desired results. A particularly preferred range is from about 0.1 to about 2% by weight.

The toner compositions of the instant invention may be employed to develop electrostatic latent images on any suitable electrostatic latent image bearing surface including conventional photoconductive surfaces. Well known photoconductive materials include: vitreous selenium, organic or inorganic photoconductors embedded in a nonphotoconductive matrix, organic or inorganic photoconductors embedded in a photoconductive matrix or the like. Representative patents in which photoconductive materials are disclosed include: U.S. Pat. Nos. 2,803,542 to Ullrich; 2,970,906 to Bixby; 3,121,006 to Middleton; 3,121,007 to Middleton and 3,151,982 to Corrsin.

In U.S. Pat. No. 2,986,521, Wielicki, there is taught a reversal type developer powder for electrostatic printing comprising electroscopic material, i.e. toner, coated with a finely divided colloidal silica. The toner material must have (1) a positive triboelectric relationship with respect to the silica and (2) the silica coated toner must be repelled from negatively charged areas of an imaging surface. The only positively stated purpose or utility for the silica is to reduce tackiness and improve the free flowing characteristics of the developer powder.

In copending U.S. Ser. No. 718,004, filed on Apr. 1, 1968 in the name of Frank M. Palermiti, now abandoned, it is taught that the inclusion at a minor proportion of hydrophobic metal salt of a fatty acid in an electrostatic developer overcomes certain problems associated with the use of prior art toner and carrier materials. Among the problems are the tendency of the toner to form unwanted deposits which interfere with copy quality and the long term abrasive affects of carriers and some toners. The metal salt of a fatty acid overcomes these problems, however, it has been observed that excessive buildup of the metal salt can likewise cause degradation of copy quality.

In U.S. Pat. No. 3,552,850 issued to Stephen F. Royka et al., it is taught to employ a dry lubricant when employing a blade cleaner in an electrostatographic imaging system. This patent, however, does not teach how to control the deleterious buildup of dry lubricant.

DESCRIPTION OF THE PREFERRED EMBODIMENT

The following examples further define, describe and compare exemplary methods of preparing the development system components of the present invention and of utilizing them in a development and cleaning process. Parts and percentages are by weight unless otherwise indicated. The examples, other than the control examples, are also intended to illustrate the various preferred embodiments of the present invention.

EXAMPLE I

The vitreous selenium drum of an automatic copying machine is corona charged to a positive voltage of about 800 volts and exposed to a light and shadow image to form an electrostatic latent image. The selenium drum is then rotated through a magnetic brush development station. A control developer comprising 2 parts of toner, containing a polystyrene resin and about 100 parts of steel shot carrier beads. The toner particles have an average particle size of about 12 microns and the carrier beads an average particle size of about 125 microns. After the electrostatic latent image is developed in the developing station, the resulting toner image is transferred to a sheet of paper at a transfer station. The residual toner particles remaining on the selenium drum after passage through the transfer station is removed by three different techniques. In each case, and in subsequent examples, it is to be understood that a clean selenium drum is employed in the examples.

One technique employs a cylindrical brush having an overall diameter of about 4 inches, a 15 denier polypropylene having a pile height of about ⅜ inch, and a fiber density of about 54,000 fibers per square inch. The brush is positioned against the drum to permit a fiber interference of about 0.1 inch and is rotated at about 175 revolutions per minute. Initial copy quality is excellent, however, after 25,000 copies, background density is very high, resolution is markedly decreased, image fill in solid and line copy is poor and edge definition is poor. Inspection of the drum reveals slight signs of wear and a significant buildup of toner on the surface thereof.

A second technique employs a cleaning web of the type disclosed by W. P. Graff, Jr. et al. in U.S. Pat. No. 3,186,838. A nonwoven rayon web contact pressure of about 18 pounds per square inch, web-photoreceptor relative speed of about 1.5 inches per second, and a web contact arc distance of about ⅛ inch are employed. After the copying process is repeated 5000 times, the copies show fairly good line contrast and little background deposit. However, large solid areas possess a washed out appearance. Micrograph studies of the drum surface reveal a significant buildup of toner film.

A third technique employs a doctor blade cleaning mode of removing residual toner. A rectangular 1/16 inch thick strip of polyurethane rubber-like material, having one end chamfered to form a cleaning edge having an angle of about 60°, is positioned parallel to the axis of the drum. The chamfered edge of the blade is held at a chiseling rather than wiping attitude with respect to the moving drum. The vertical resultant force employed to press the entire blade edge against the drum surface is about three pounds as read on a spring scale. Initial copies reveal good copy quality in all respects, however, after about 2000 copies, image quality is markedly inferior showing high background density, poor image fill and decreased resolution. Inspection of the drum reveals a significant buildup of toner on the imaging surface.

The foregoing illustrates the problem encountered when employing a typical toner material which of its very nature has a tendency to build up on the photoreceptor. The increasing buildup is undoubtedly the main cause of decline in copy quality.

EXAMPLE II

The developer procedure of Example I is repeated except that the developer is modified in the following manner: about 0.1 part of zinc stearate having a particle size distribution of from 0.75–40 microns is gently folded into one part of toner. The resulting mixture is thoroughly milled in a Szegvari attritor for about 10 minutes. After developed image transfer, as in Example I, the doctor blade and technique of Example I is employed except the blade force used is 0.2 pounds. After about 2000 cycles, the copies are characterized by high density and high background deposits. The surface of the selenium drum will be observed to have an excessive film buildup. The film deposit is either zinc stearate or a combination of the same with toner.

By increasing the blade force on the photoreceptor drum to about three pounds copy quality remained good through 2000 cycles.

The foregoing example illustrates that by employing a representative friction-reducing material, i.e., zinc stearate, in the developer composition, coupled with a cleaning means supplying sufficient force during cleaning, deleterious film buildup is effectively controlled.

The following examples illustrate that by employing a comparatively abrasive material in conjunction with the film forming lubricant, copies of exceptionally high quality are obtained by an even more effective control of film buildup.

EXAMPLE III

The developing procedure of Example I is repeated except that the developer is modified in the following manner: To the toner of Example I, 0.25% of zinc stearate is added and milled in a Szegvari attritor for ten minutes. Thereafter, 1.0% by weight of a treated submicron silicon dioxide is added and milled for an additional ten minutes. The treated silicon dioxide particles are produced by flame hydrolysis decomposition of pure silicon tetrachloride in the gaseous phase in an oxyhydrogen flame at about 1100°C followed by reaction in a heated fluidized bed reactor with dimethyl dichlorosilane. About 75% of the silanol groups present on the surface of the freshly prepared silicon dioxide particles are reacted with the silane in the fluidized bed reactor. The silicon dioxide particles have about 3 silanol groups per 100 $A^2$ of a surface prior to reaction with silane. Analysis of the final product reveals 99.8% $SiO_2$ and the balance carbon, Cl, heavy metals, $Fe_2O_3$, $Al_2O_3$, $TiO_2$ and $Na_2O_3$. The particle size is between about 10–30 millimicrons and the surface area is about 90–150 $m^2/g$.

The relative coefficient of friction values for the several materials, determined by the technique described above, are as follows: Selenium 5.23, toner 3.92 and zinc stearate 0.67. The toner has a Shore Durometer hardness of greater than 100 on the A and B scale, zinc stearate 66 on the A scale and 52 on the B scale. The treated silicon dioxide has a hardness of about 5 on Moh's scale. After developed image transfer as in Example I, the blade cleaning technique of Example I is employed utilizing a blade force of about 3 pounds. After 2000 cycles, the copies are characterized by the same exceptionally high image quality as the initial copies. Inspection of the selenium drum will reveal a film buildup of less than 300 A.

EXAMPLE IV

The process of Example III is repeated except the dual additive consists of 0.25% of 10–20 micron cadmium stearate and 1.0% of 200 millimicron Kaophile 2, a commercially available hydrophobic aluminum silicate. The coefficient of friction of the cadmium stearate is 0.25 and the Shore Durometer hardness is 78 on the A scale and 66 on the B scale. After 2000 cycles, this developer yields copies of exceptional quality in every respect. The film buildup on the photoreceptor does not exceed 500 A.

EXAMPLE V

The process of Example III is repeated except the dual additive consists of 0.25% of 2–140 micron glycerol monostearate and 1.0% of the treated $SiO_2$ of Example III. The coefficient of friction of the glycerol monostearate is 1.57 and the Shore Durometer hardness is A scale 67, B scale 31. After 2000 cycles, this developer yields copies of outstanding quality in every respect. The film buildup on the photoreceptor does not exceed 300 A.

EXAMPLE VI

The process of Example III is repeated except the dual additive consists of 4.0% Carbowax 4000, a commercially available polyethylene glycol having a molecular weight of about 4000 and a particle size of 2–14 microns, and 6.0% Aerosil R972. The Aerosil R972 is a commercially available material substantially identical to the treated silica of Example III. The coefficient of friction of the Carbowax is 4000 is 1.63 and the Shore Durometer hardness is A scale 95. The residual developer material remaining on the selenium drum after passage through the transfer station is removed by a rotating cylindrical brush and vacuum system. After 2000 cycles, this developer yields copies of excellent quality. The film buildup on the photoreceptor is not in excess of 700 A.

EXAMPLE VII

The process of Example III is repeated except the dual additive consists of 0.25% cholesterol and 1.0% Aerosil R972. The cholesterol has a particle size range of 5–140 microns, a coefficient of friction of 2.1 and a Shore Durometer hardness of B scale 72. After 2000 cycles, copies of excellent quality were realized. The film buildup on the photoreceptor is not in excess of 300 A.

EXAMPLE VIII

The process of Example III is repeated except the dual additive is 0.25% PCL-150, which is a commercially available polycaprolactone having a molecular weight of about 4000, and 1.0% Aerosil R972. The PCL-150 has a particle size range of 2-140 microns, a coefficient of friction of 2.0 and a Shore Durometer hardness of A scale 95. After 2000 cycles this developer yields copies of outstanding quality in every respect. The film buildup on the photoconductor is not in excess of 300 A.

EXAMPLE IX

The process of Example III is repeated except the dual additive is 0.25% Vydax, a low molecular weight, waxy, smearable telomer of tetrafluoroethylene available from E. I. DuPont, Wilmington, Delaware, and 1.0% Aerosil R972. Vydax has a particle size range of from 2–100 microns, a coefficient of friction of less than that of the toner material, a Shore Durometer hardness of 72 on the B scale and a melting point of 300°C. After 2000 cycles, this developer yields copies of a quality comparable to that of Examples III–VIII. Residual film buildup will not exceed 300 A.

EXAMPLE X

The process of Example III is repeated except the dual additive consisted of 0.25% terephthalic acid and 1.0% Aerosil R972. The terephthalic acid has a coefficient of friction of 0.40 and a Shore Durometer hardness of 96 on the B scale. This developer, after 2000 cycles, likewise yields copies of a quality comparable to that of Examples III–VIII. Residual film buildup will not exceed 400 A.

EXAMPLE XI

The process of Example III is repeated except the dual additive consists of 0.25% perchloropentacyclodecane and 1.0% titanium dioxide. The perchloropentacyclodecane has a coefficient of friction of 1.0 and a Shore Durometer hardness of 87 on the B scale. The titanium dioxide has an average particle size of about 30 millimicrons. This developer, after 2000 cycles, yields copies of a quality comparable to that of Examples III–VIII. The residual film buildup will not exceed 300 A.

EXAMPLE XII

The process of Example III is repeated except the dual additive consists of 0.25% stearyl alcohol and 1.0% antimony trioxide. The stearyl alcohol has a coefficient of friction less than that of the toner and a Shore Durometer hardness of less than that of the toner. The antimony trioxide powder has an average particle size of 100 millimicrons. This developer, after 2000 cycles, yields copies of a quality comparable to that of Examples III–VIII. The residual film buildup will not exceed 400 A.

EXAMPLE XIII

The process of Example III is repeated except the dual additive consists of 0.25% zinc stearate and 1.0% untreated submicron silicon dioxide. The silicon dioxide is identical to that of Example III except it is not treated to render it organophilic. The process is operated at a relative humidity of about 80% at an average temperature of about 75°F. The background density, resolution, image fill in line copies and edge definition are good in initial copies. However, after about 900 copies, background density has more than doubled, resolution has decreased, image-fill in line copies is poor and edge-definition is poor. The photoreceptor reveals a dull damp claylike film which cannot be removed by ordinary cleaning techniques.

The same process carried out at a relative humidity of 30% at about 75°F yields excellent copies after about 2000 cycles. No claylike film is observed on the photoreceptor surface.

When the treated silicon dioxide of Example III is employed in the composition under the high relative humidity condition of about 80% at 75°F image quality remains excellent and no colloidal silica deposit is observed on the photoreceptor.

It is believed that the voluminous, high surface area, untreated silica acts as desiccant and the water taken up by the additive deleteriously affects all aspects of the development and cleaning steps of the process. Under comparatively dry conditions this is not observed.

EXAMPLE XIV

The process of Example II is repeated except a reversal development mode is employed. About 100 parts of 250 micron steel shot, the particles of which are coated with a mixture of a copolymer of polyvinylchloride and polyvinylacetate with Luxol Fast Blue, a commercially available dye, is mixed with 1 part of a toner consisting of 65% polystyrene, 35% poly-n-butylmethacrylate and 10% carbon black. This reversal developer also contains 1.0% by weight of $Al_2O_3$ based on the weight of toner. The $Al_2O_3$ has an average particle size of 30 millimicrons. Effective development is achieved in the discharged areas of the imaging surface. After 1000 cycles, the copies are excellent in every respect. Residual developer buildup on the imaging surface will not exceed 300 A.

EXAMPLE XV

The developing procedure of Example III is repeated except instead of zinc stearate, 0.25% of copper stearate is employed. The coefficient of friction of the copper stearate is less than that of the toner and its Shore Durometer hardness is less than that of the toner. After 2000 cycles, this developer yields copies of good quality in every respect. The film buildup on the photoreceptor does not exceed 300 A.

Although specific materials and conditions are set forth in the foregoing examples, these are merely intended as illustrations of the present invention. Various other suitable toner components, additives, colorants, carriers and development techniques such as those listed above may be substituted for those in the examples with similar results. Other materials may also be added to the toner or carrier to sensitize, synergize or otherwise improve the imaging properties or other desirable properties of the system.

Other modifications of the present invention will occur to those skilled in the art upon a reading of the present invention. These are intended to be included within the scope of this invention.

What is claimed is:

1. A composition for development of electrostatographic images comprising discrete particles and carrier, said particles including discrete, finely divided electroscopic toner materials having an average particle size of less than about 30 microns; from about 0.01 to about 10 percent by weight based on the weight of said toner of a discrete, finely divided, solid, friction-reducing material having a hardness less than said toner material and having greater friction-reducing characteristics than said toner material, said friction-reducing material having a greater tendency than said toner material of forming a thin, adherent film deposit on a surface when applied from a mixture of said materials with a shearing force; and from about 0.01 to about 10 percent by weight based upon the weight of said toner of a discrete, finely divided, nonsmearable abrasive material having an average particle size between about 1 and about 500 millimicrons and having a hardness greater than said friction-reducing and toner materials.

2. The developing material according to claim 1 wherein said developing material comprises from about 0.1 percent to about 2 percent by weight of said friction-reducing material based on the weight of said toner material; and from about 0.1 percent to about 2 percent by weight of said abrasive material based on the weight of said toner material.

3. The developing material of claim 1 wherein said abrasive material has an average particle size between about 10 millimicrons and about 100 millimicrons.

4. The developing material of claim 1 including from 10–1000 parts by weight of carrier particles per part of toner material said carrier particle being grossly larger than said finely divided toner material.

* * * * *